US008111862B2

(12) United States Patent
Wu

(10) Patent No.: US 8,111,862 B2
(45) Date of Patent: Feb. 7, 2012

(54) EAR-HANGING MICROPHONE

(75) Inventor: Ying Jui Wu, Taipei (TW)

(73) Assignee: Ying Jui Wu, Taipei (TW)

( * ) Notice: Subject to any disclaimer, the term of this patent is extended or adjusted under 35 U.S.C. 154(b) by 1138 days.

(21) Appl. No.: 11/924,622

(22) Filed: Oct. 26, 2007

(65) Prior Publication Data

US 2008/0267430 A1 Oct. 30, 2008

(51) Int. Cl.
*H04R 1/10* (2006.01)

(52) U.S. Cl. ..... 381/381; 381/150; 381/361; 381/364; 381/367

(58) Field of Classification Search ..... 381/122, 381/150, 361, 364, 367, 381, 375, 378, 379, 381/356, 359, 362, 151, 355, 328, 330, 376, 381/380

See application file for complete search history.

(56) References Cited

U.S. PATENT DOCUMENTS

| | | | | |
|---|---|---|---|---|
| 4,640,570 | A * | 2/1987 | Strate | 439/668 |
| 7,564,988 | B2 * | 7/2009 | Azima et al. | 381/326 |
| 2007/0116315 | A1 * | 5/2007 | Darbut | 381/367 |
| 2009/0147971 | A1 * | 6/2009 | Kuhr et al. | 381/109 |

* cited by examiner

*Primary Examiner* — Ha Tran T Nguyen
*Assistant Examiner* — Suberr Chi
(74) *Attorney, Agent, or Firm* — CKC & Partners Co., Ltd.

(57) ABSTRACT

An ear-hanging microphone comprising; a c-shaped hanger; a cable pole, whose first end connecting said hanger at a first end thereof; a flexible strap, whose two ends being twisted on said hanger, and the length of said flexible strap being shorter than the longest one of the diameters of said hanger; a microphone, which connecting said cable pole at a second end thereof; a stop block, which connecting said hanger at a second end thereof; a socket, which being embedded in said stop block, and said socket and said microphone being linked electrically; a pin, which being correspondingly inserted into said socket to realize electrical link; and an electrical cable, which being linked electrically with said pin. Because of the usage of the flexible strap, the usage period of the ear-hanging microphone is prolonged and the user feels more comfortable and convenienter.

6 Claims, 1 Drawing Sheet

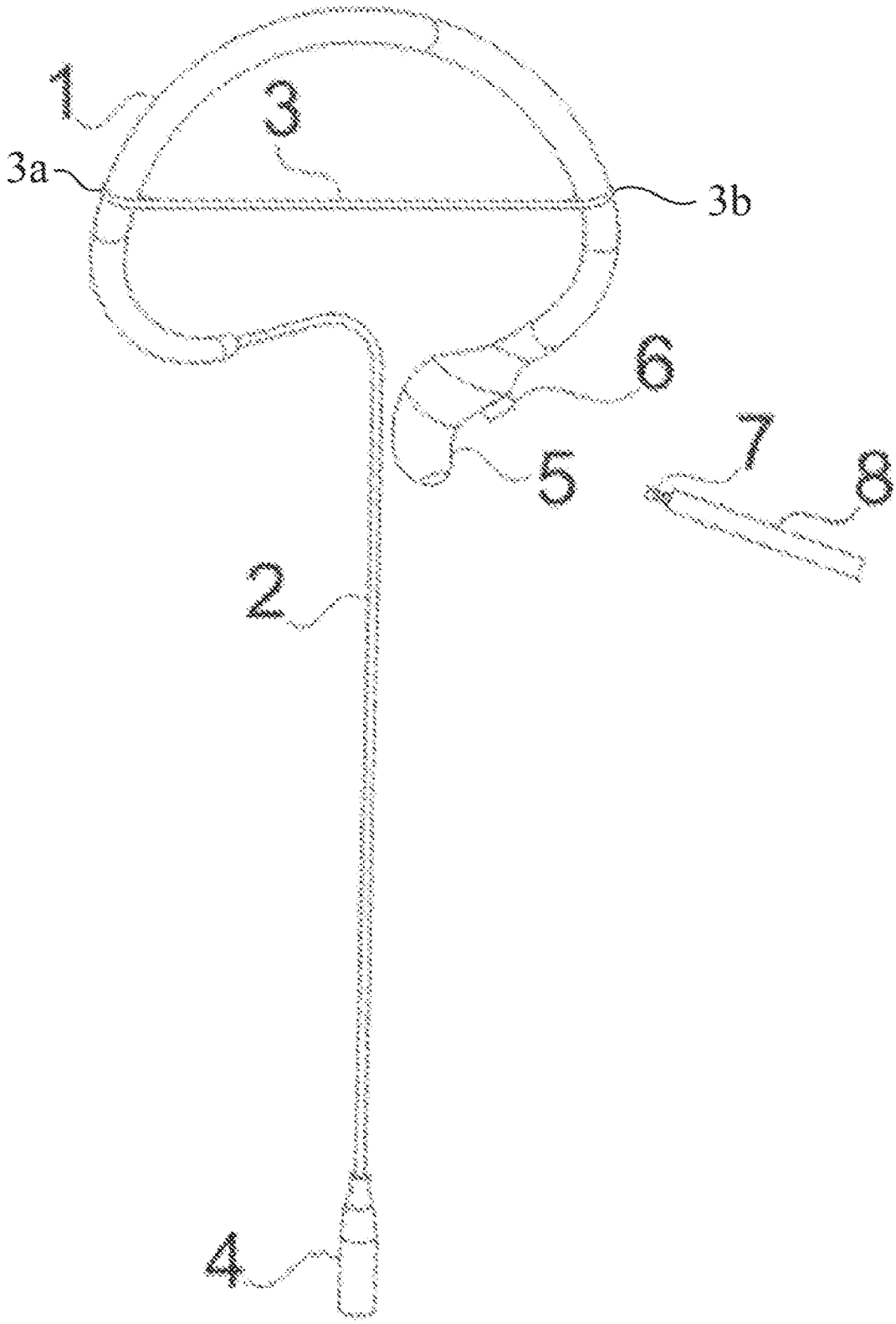
1
3
3a
3b
6
5
7
8
2
4

EAR-HANGING MICROPHONE

BACKGROUND OF THE INVENTION

The present invention relates to a microphone, in particular to a microphone that can be carried conveniently, and the position of the microphone can be adjusted, and the microphone is not easy to distort.

At present, microphone is an very usual electronic commodity in people's life. There are many different kinds of microphone products. Headset microphone is very popular, but it is inconvenient to carry and can't adjust its position according to the shape and size of user's head.

Many ear-hanging microphone is not flexible. After the hanger is worn on a big ear of the first people, the hanger of the ear-hanging microphone is pushed to be so bigger and the shape of the bigger hanger can't resume. The second people having small ears feels the hanger too loose when he wears the hanger on his ear. This problem disturbs not only usage convenience but also user's mood.

BRIEF SUMMARY OF THE INVENTION

The object of the present invention is to provide a microphone, the microphone can be carried conveniently, and the position of the microphone can be adjusted, and the microphone is not easy to distort.

The present invention provides an ear-hanging microphone comprising: a c-shaped hanger; a cable pole, whose first end connecting said hanger at a first end thereof; a flexible strap, whose two ends being twisted on said hanger, and the length of said flexible strap being shorter than the longest one of the diameters of said hanger; a microphone, which connecting said cable pole at a second end thereof; a stop block, which connecting said hanger at a second end thereof; a socket, which being embedded in said stop block, and said socket and said microphone being linked electrically; a pin, which being correspondingly inserted into said socket to realize electrical link; and an electrical cable, which being linked electrically with said pin.

The ear-hanging microphone has some obvious advantages: small volume, convenient carrying, stable hanging on ear, convenient adjustment of the position. Because of the usage of the flexible strap, the usage period of the ear-hanging microphone is prolonged and the user feels more comfortable and convenienter.

BRIEF DESCRIPTION OF THE DRAWINGS

FIG. 1 is an assembly drawing of the embodiment of the present invention.

DETAILED DESCRIPTION OF THE INVENTION

As shown in FIG. 1, FIG. 1 is an assembly drawing of an ear-hanging microphone being disclosed in the patent. The ear-hanging microphone includes a c-shaped hanger 1, a cable pole 2, a flexible strap 3, a microphone 4, a stop block 5, a socket 6, a pin 7 and an electrical cable 8.

The hanger 1 is worn on an ear of a user's. The hanger 1 is unenclosed and semicircular, so the hanger 1 produces such a strong force that the hanger 1 nips the ear tightly, and so the hanger 1 keeps hanging on the ear.

The cable pole 2 is linear. A first end of the cable pole 2 connects the hanger 1 at a first end thereof. The cable pole 2 and the hanger 1 are integrative in production.

The flexible strap 3 is made of a kind of plastic material. Two distal ends of the flexible strap 3 are twisted on the hanger 1. The length of the flexible strap 3 is shorter than the longest one of the diameters of the hanger 1.

The microphone 4 connects the cable pole 2 at a second end thereof.

The stop block 5 connects the hanger 1 at a second end thereof. The stop block 5 presses on the rear portion of the ear while the hanger 1 is being hung on the ear.

The socket 6 is embedded in the stop block 5. The socket 6 and the microphone 4 is linked electrically with some cables (not shown in drawings). There are many inner screw threads (not marked in drawings) inside the socket 6.

The pin 7 comprises many outer screw threads (not marked in drawings) corresponding to the inner screw threads of the socket 6. The pin 7 inserts into the socket 6 to realize electrical link. And it is much stabler when the outer screw threads and the inner screw threads lock each other.

The electrical cable 8 is linked electrically with the pin 7.

By means of the connection of the outer screw threads and the inner screw threads, the electrical cable 8, the pin 7, the socket 6 and the microphone 4 are all linked electrically.

To use the ear-hanging microphone, firstly, you should hang it on your ear, then you should adjust the positions of the cable pole 2 or the microphone 4 to make the microphone 4 to a suitable position near user's mouth. Because of flexibility of the hanger 1, the ear-hanging microphone is hung on the ear stably. The stop block 5 can make the ear-hanging microphone much stabler, moreover, the ear feels more comfortable because of the stop block 5. The flexible strap 3 can help user renew the hanger 1 much easier.

The ear-hanging microphone has many advantages: small volume, convenient carrying. Because of the usage of the flexible strap 3, the usage period of the ear-hanging microphone is prolonged and the user feels more comfortable and convenienter. Furthermore, when the electrical cable 8 is damaged, we can renew it conveniently, that is to say, the usage period of the ear-hanging microphone is prolonged. The pin 7 connects the socket 6 by the interaction between the outer screw threads and the inner screw threads, so it benefits to avoid the electrical cable 8 falling off.

What is claimed is:

1. An ear-hanging microphone comprising:

a c-shaped hanger defining a plurality of distances each between two spatially separated points along a length of said hanger, one of the distances being longer than any of the other distances to thereby form a longest distance;

a cable pole, whose first end connects said hanger at a first end thereof;

a flexible strap, whose two ends being twisted on said hanger, and the length of said flexible strap being shorter than the longest distance of said hanger;

a microphone, which connecting said cable pole at a second end thereof;

a stop block, which connecting said hanger at a second end thereof;

a socket, which being embedded in said stop block, and said socket and said microphone being linked electrically;

a pin, which being correspondingly inserted into said socket to realize electrical link; and an electrical cable, which being linked electrically with said pin.

2. An ear-hanging microphone according to claim 1, wherein said hanger is unenclosed and semicircular.

3. An ear-hanging microphone according to claim 1, wherein said cable pole is linear.

4. An ear-hanging microphone according to claim 1, wherein said cable pole and said hanger are integrative in production.

5. An ear-hanging microphone according to claim 1, wherein said flexible strap is made of a kind of plastic material.

6. An ear-hanging microphone according to claim 1, wherein there are many inner screw threads inside said socket, and said pin comprises many outer screw threads corresponding to said inner screw threads, and said outer screw threads and said inner screw threads lock each other.

* * * * *